US007297045B2

(12) United States Patent
Pierson et al.

(10) Patent No.: US 7,297,045 B2
(45) **Date of Patent: *Nov. 20, 2007**

(54) SMART SMOKE UNIT

(75) Inventors: Martin D. Pierson, Howell, MI (US); James M. Rohde, Walled Lake, MI (US)

(73) Assignee: Lionel L.L.C., Chesterfield, MI (US)

( * ) Notice: Subject to any disclaimer, the term of this patent is extended or adjusted under 35 U.S.C. 154(b) by 464 days.

This patent is subject to a terminal disclaimer.

(21) Appl. No.: 10/190,465

(22) Filed: Jul. 5, 2002

(65) Prior Publication Data

US 2004/0005836 A1 Jan. 8, 2004

(51) Int. Cl.
*A63H 19/14* (2006.01)

(52) U.S. Cl. ..... 446/467; 446/24; 446/25; 105/1.5; 392/386

(58) Field of Classification Search ..... 446/467, 446/24, 25, 484; 105/1.5; 392/386, 395–398, 392/402–406

See application file for complete search history.

(56) References Cited

U.S. PATENT DOCUMENTS

| | | | | |
|---|---|---|---|---|
| 2,015,438 | A * | 9/1935 | Smith | 392/403 |
| 3,170,789 | A * | 2/1965 | Woodward et al. | 420/453 |
| 3,234,357 | A * | 2/1966 | Seuthe | 446/24 |
| RE26,563 | E * | 4/1969 | Seuthe | 446/25 |
| 3,574,612 | A * | 4/1971 | Maness | 420/451 |
| 3,891,826 | A * | 6/1975 | Seuthe et al. | 446/24 |
| 4,668,855 | A * | 5/1987 | Wilson et al. | 392/385 |
| 5,351,167 | A * | 9/1994 | Wai et al. | 336/192 |
| 5,512,001 | A * | 4/1996 | Kent et al. | 446/25 |
| 6,280,278 | B1 * | 8/2001 | Wells | 446/25 |
| 6,457,681 | B1 | 10/2002 | Wolf et al. | |
| 6,619,594 | B2 | 9/2003 | Wolf et al. | |
| 6,655,640 | B2 | 12/2003 | Wolf et al. | |
| 6,676,473 | B2 * | 1/2004 | Pierson et al. | 446/25 |
| 7,125,309 | B2 * | 10/2006 | Pierson et al. | 446/25 |

FOREIGN PATENT DOCUMENTS

| | | | |
|---|---|---|---|
| DE | 1187165 | A * | 2/1965 |
| DE | 2631639 | A * | 1/1978 |
| JP | 05106827 | A * | 4/1993 |
| JP | 09225339 | A * | 9/1997 |
| WO | WO 9830830 | A1 * | 7/1998 |

OTHER PUBLICATIONS

Aerosleeves—High Performance Composites, "Fiberglass Sleeves", Internet—http://www.aerosleeves.com/order/?r=1&material=fiberglass, 2005.*

* cited by examiner

*Primary Examiner*—Eugene Kim
*Assistant Examiner*—Urszula M Cegielnik
(74) *Attorney, Agent, or Firm*—O'Melveny & Myers LLP

(57) ABSTRACT

A smoke generating device for a model train that includes a smoke generating element supported by a support member. The smoke generating element can be wound around the support member is a generally helical pattern. The number of turns and the distance between turns can be varied to enhance the smoke generating properties of the device. The support member can be braided fiberglass. A length and cross-section of the support member can be varied to support smoke generating elements of different lengths. The length of the smoke generating element can be varied to produce smoke generating devices having different resistive values.

21 Claims, 5 Drawing Sheets

FIG-1
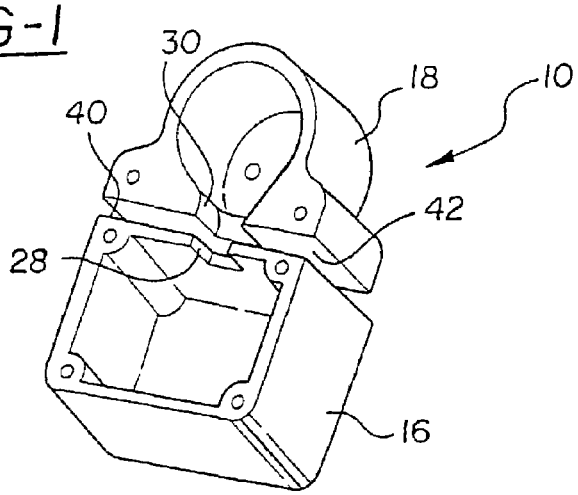
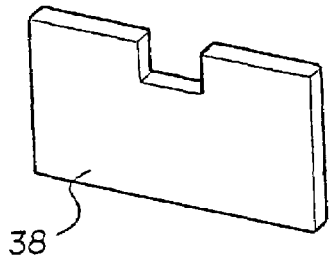
FIG-2
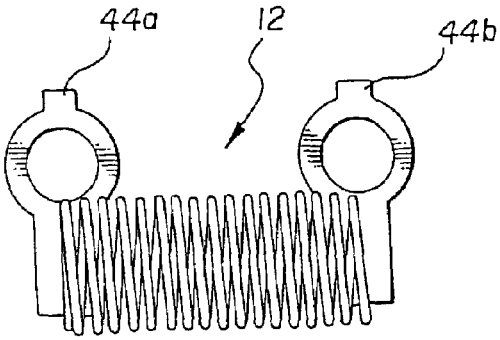
FIG-3A
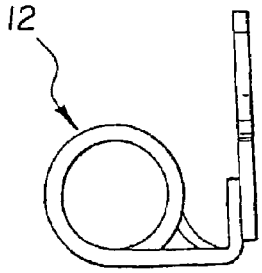
FIG-3B
FIG-4
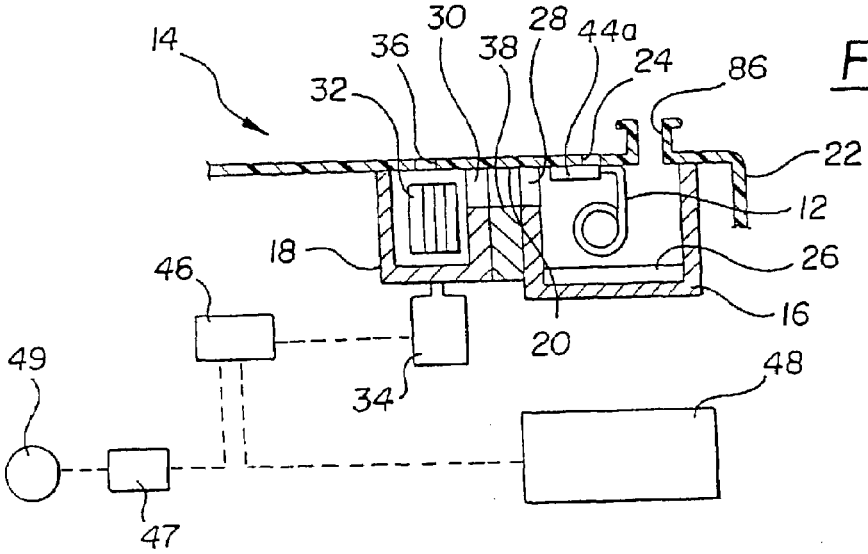

FIG-10
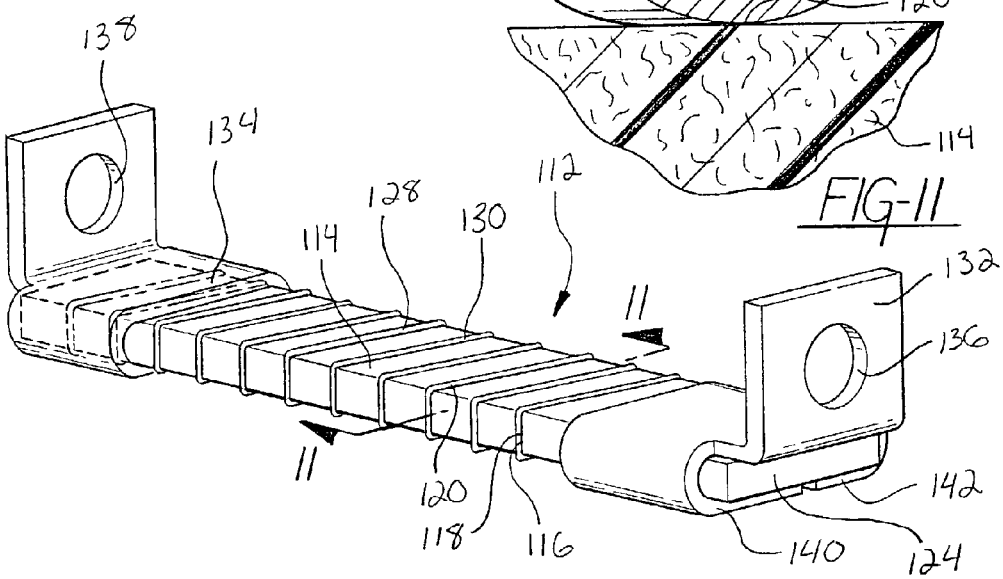
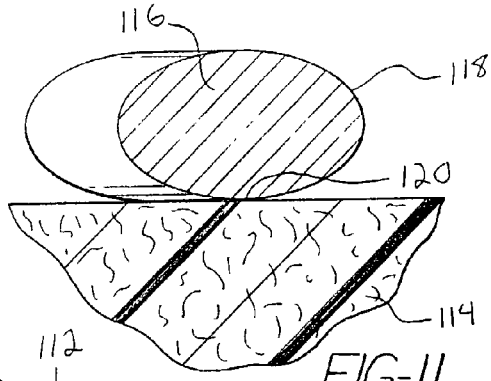
FIG-11
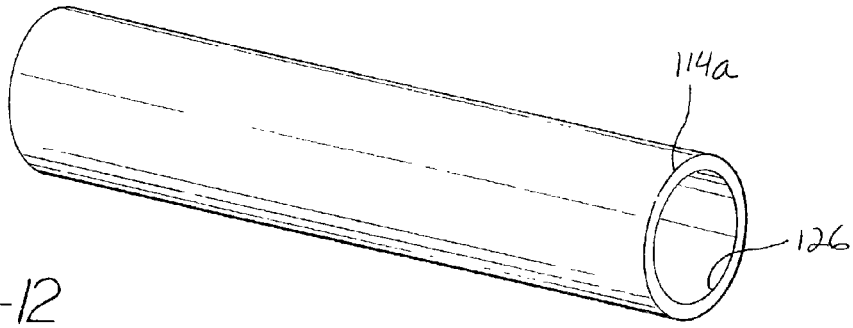
FIG-12
FIG-13
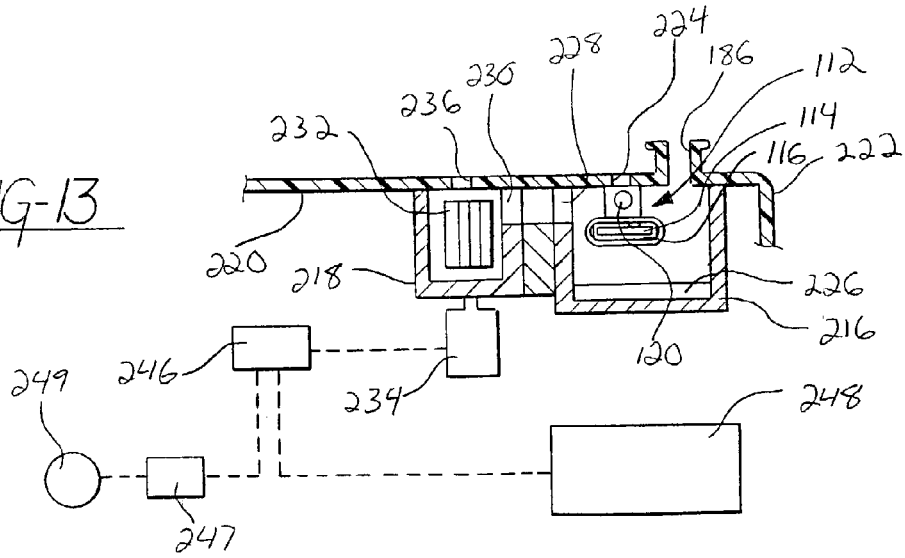

SMART SMOKE UNIT

FIELD OF THE INVENTION

The invention relates to a smoke generating device for a model train, and, more specifically, the invention provides a smoke generating device that can change the rate of smoke generated in response to load changes experienced by the engine of the model train.

BACKGROUND OF THE INVENTION

Model train engines having smoke generating devices are well known. However, current smoke generating devices for model trains do not mimic the generation of smoke of a real train as closely as desired. Real trains generate smoke at a rate proportional to the loading of the engine of the train notwithstanding the speed at which the train is moving. This characteristic is not available in model toy trains. The heat generated by known smoke generator can cause the smoke generator to fail. The present invention solves these and other problems with the prior art.

SUMMARY OF THE INVENTION

The present invention provides an apparatus for generating smoke for a model toy train. The invention includes a smoke generator having a support member for supporting a smoke generating element. The smoke generating element can be braided fiber glass. The support member can be solid or hollow. The support member can be any formed with any desirable cross-section, including rectangular or tubular.

The invention also provides a method for generating smoke from a model train. Smoke is generated with the smoke generating element connected to the train. A blower generates an air stream to move smoke out of the train. A controller controls the blower to generate the air stream at a particular rate in response to a signal corresponding to the load on the train.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIG. 1 is an isometric view of a housing according to an embodiment of the present invention;

FIG. 2 is an isometric view of an insulating gasket according to an embodiment of the present invention;

FIG. 3A is a front view of a smoke generating element according to an embodiment of the present invention;

FIG. 3B is a side view of a smoke generating element according to an embodiment of the present invention;

FIG. 4 is a cross sectional view of a smoke generating apparatus mounted to a model train according to an embodiment of the present invention;

FIG. 10 is an isometric view of a first preferred smoke generating element having a support member according to an embodiment of the present invention;

FIG. 11 is a partial cross-sectional view of the smoke generating apparatus according to an embodiment of the present invention;

FIG. 12 is an alternative embodiment of a support member according to the present invention; and FIG. 13 is a cross-sectional view of a smoke generating apparatus having a support member mounted to a model train according to an embodiment of the present invention.

DESCRIPTION OF THE PREFERRED EMBODIMENT

Figure 5:
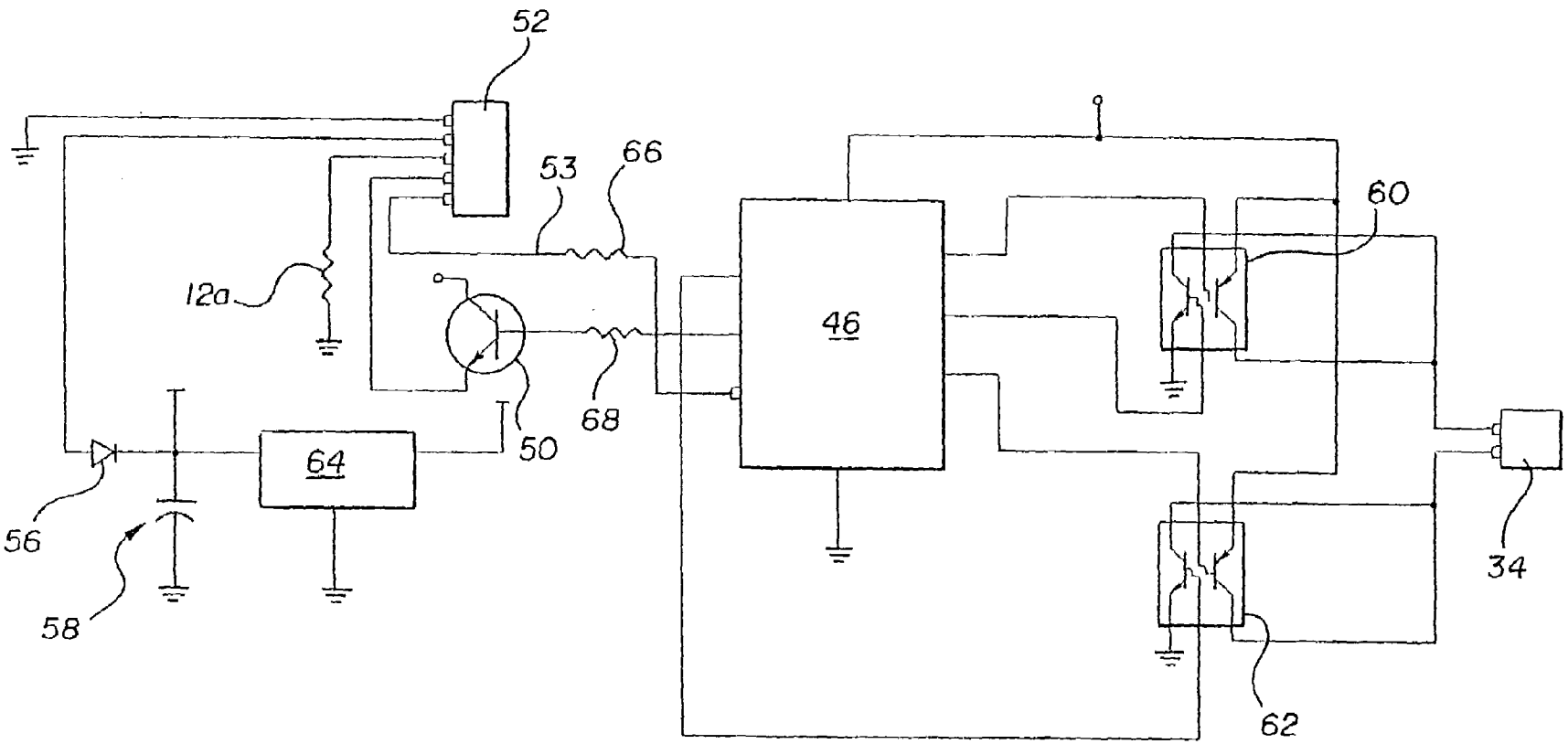
FIG. 5 is a circuit schematic of the smoke generating device according to an embodiment of the present invention.

The present invention provides a smoke generator for a model train. The smoke generator includes a smoke generating element operably associated with a support member. Generally, the smoke generating element can be wound around the support member such that the support member acts as a core to a helix defined by the smoke generating element. However, the support member can be used to support a substantially linear smoke generating element. The support member can support substantially the entire length of the smoke generating element or a portion of the smoke generating element. The smoke generating element can be a nickel chromium wire. The nickel chromium wire is held in place with fasteners engaged with ends of the wire. The support element supports the wire, enhancing wire life and performance.

Referring now to FIGS. 1 and 4, the invention includes a housing 10, a smoke generating element 12 and a blower 14 for emitting smoke from a model train 22. The housing 10 includes a first sub-housing 16 and a second sub-housing 18. First sub-housing 16 is mounted to an interior surface 20 of the model train model train 22 and houses oil used in a smoke generating process. Oil is directed through an aperture 24 of model train 22. While an oil burning smoke element is shown, the invention can be practiced with any type of smoke generator and any type of smoke generating process known in the art. For example, the smoke generator can be an ultrasonic wave nebulizer, a device for generating smoke-filled bubbles, or any other method disclosed by the references cited.

The first sub-housing 16 is shown as generally rectangular. First sub-housing 16 can be any geometric shape, such as circular or irregularly shaped. The shape of first sub-housing 16 can be limited only to the extent that the first sub-housing 16 is preferably mounted in the interior of model train 22 and smoke generating element 12 can be extendable into first sub-housing 16.

First sub-housing 16 includes an opening 28. Opening 28 of first sub-housing 16 is aligned with an opening 30 of second sub-housing 18. Openings 28 and 30 place the first and second sub-housing 16 and 18 in fluid communication with each other. Openings 28 and 30 are shown in FIGS. 1 and 4 as generally rectangular in cross-section, however, the openings 28 and 30 can be any geometric configuration. While the first and second sub-housings 16 and 18 are shown positioned adjacent to each other, the invention can be practiced with first and second sub-housings positioned spaced apart relative to each other. A conduit can be positioned between the first and second sub-housings 16 and 18 to place the first and second sub-housings 16 and 18 in fluid communication with each other.

Second sub-housing 18 can be shaped to correspond to the shape of fan 32. In particular, the second sub-housing 18 is circular in shape to correspond to the squirrel cage fan 32 used in the illustrated embodiment. Second sub-housing 18 can be shaped to conform to the style of the fan 32 selected for use in a particular embodiment of the present invention. On the other hand, it is not necessary that the second sub-housing 18 be shaped to correspond to the shape of fan 32. For example, second sub-housing 18 can be rectangular shaped and house a squirrel cage fan 32.

Housing 10 can be fabricated from any material having sufficient rigidity and thermal resistance. Housing 10 supports the blower 14 and the smoke generating element 12. For example, housing 10 can be fabricated from aluminum, steel, cast iron, plastic, or an appropriate alloy. Preferably the housing 10 can be fabricated from an alloy having the trade name "Zamak 3." Zamak is a well known alloy of zinc, copper, aluminum and magnesium. In addition, in an embodiment of the invention including first and second sub-housings 16 and 18, the first and second sub-housings 16 and 18 can be fabricated or formed with different materials.

Referring now to FIG. 2, the present invention can also include a gasket 38. Gasket 38 can thermally insulate the second sub-housing 18 with respect to the first sub-housing 16. Gasket 38 can be advantageous to thermally insulate the blower 14 from thermal energy emitted by smoke generating element 12. Gasket 38 can be shaped to correspond to opposing sides 40 and 42 of first and second sub-housing 16 and 18, respectively, of housing 10. Gasket 38 can be shaped in any desired geometric configuration so long as first and second sub-housings are in fluid communication with respect to each other. In a preferred embodiment of the present invention, gasket 38 is fabricated from silicone rubber rated to 500° F.

Referring now to FIGS. 3A and 3B, smoke generating element 12 includes terminals 44*a* and 44*b* at opposite ends of the smoke generating element 12. Terminals 44*a* and 44*b* are shown as ringlets. The smoke generating element can be kept at a constant temperature and can be formed as a nickel chromium wire. The terminals 44*a* and 44*b* can be integral with the nickel chromium wire of the smoke generating element 12 or can be crimped on the smoke generating element 12. Smoke generating element 12 can be engaged with interior surface 20 by rivets or screws or any other fastening means that can withstand the thermal energy emitted by the smoke generating element 12. As shown FIG. 4, the smoke generating element 12 is mounted to interior surface 20 of model train 22 and extends downwardly into first sub-housing 16.

Referring now to FIG. 4, first sub-housing 16 can include a lamina 26. Lamina 26 is a thin plate, scale or layer made of fibrous material to absorb the oil directed into first sub-housing 16 through aperture 24. Lamina 26 can absorb and retain oil to be heated by the smoke generating element 12. Lamina 26 is operable to withstand the maximum thermal energy generated by the smoke generating element 12.

The second sub-housing 18 is mounted to an interior surface 20 of model train 22 and houses a fan 32 of blower 14 for directing an air stream through the housing 10. In a preferred embodiment of the invention, fan 32 is a squirrel cage fan. However, fan 32 can also be any type of fan including, but not limited to, an axial fan, a radial flow fan, a mixed flow fan or a cross-flow fan. Fan 32 is positioned internally with respect to the second sub-housing 18. A motor 34 for rotating the fan 32 is positioned externally with respect to the second sub-housing 18. However, the invention can be practiced with the fan 32 and the motor 34 positioned internally with respect to the second sub-housing 18. Rotation of fan 32 draws the air stream through an aperture 36 of model train 22. While the aperture 36 is shown positioned adjacent the second sub-housing 18, the invention can be practiced with aperture 36 positioned spaced apart from the second sub-housing 18. A conduit can be positioned between the aperture 36 and the second sub-housing 18, placing the aperture 36 and the second sub-housing 18 in fluid communication with respect to each other. The air stream is directed through openings 30 and 28 into first sub-housing 16.

Referring now to FIG. 5, a schematic circuit diagram is provided showing the preferred electric circuit of an embodiment of the present invention. Controller 46 is a micro-controller operable to receive input signals and emit output signals and can be an PIC12C508 chip. The controller 46 is in communication with the engine of the train through a serial communication line 53 including the input connector 52. Serial communication line 53 transmits a wide variety of information with regard to model train 22. This information can include but is not limited to the velocity of train 22. Communication between the controller 46 and the input connector 52 can be enhanced with a protection resistor 66. The voltage across the engine of the train is communicated to the controller 46 with serial communication line 53. Based on a program stored in memory, the controller 46 can control the operation of the motor 34 to control an airstream generated by the fan. The controller 46 can control a rate of the airstream. The direction of the motor 34 can be controlled by alternating the voltage across the motor 34 with an H-bridge formed with a pair of chips 60 and 62. The chips 60 and 62 can be XN4316 chips and can be controlled by the controller 46. The velocity of the motor 34 can be changed by changing the level of voltage across the motor 34 with the controller 46. The circuit also includes a voltage stabilizer defined by diode 56, capacitor 58 and regulator 64. The circuit also includes an element 50 that can control a lamp or relay when a command is received.

Figure 6:
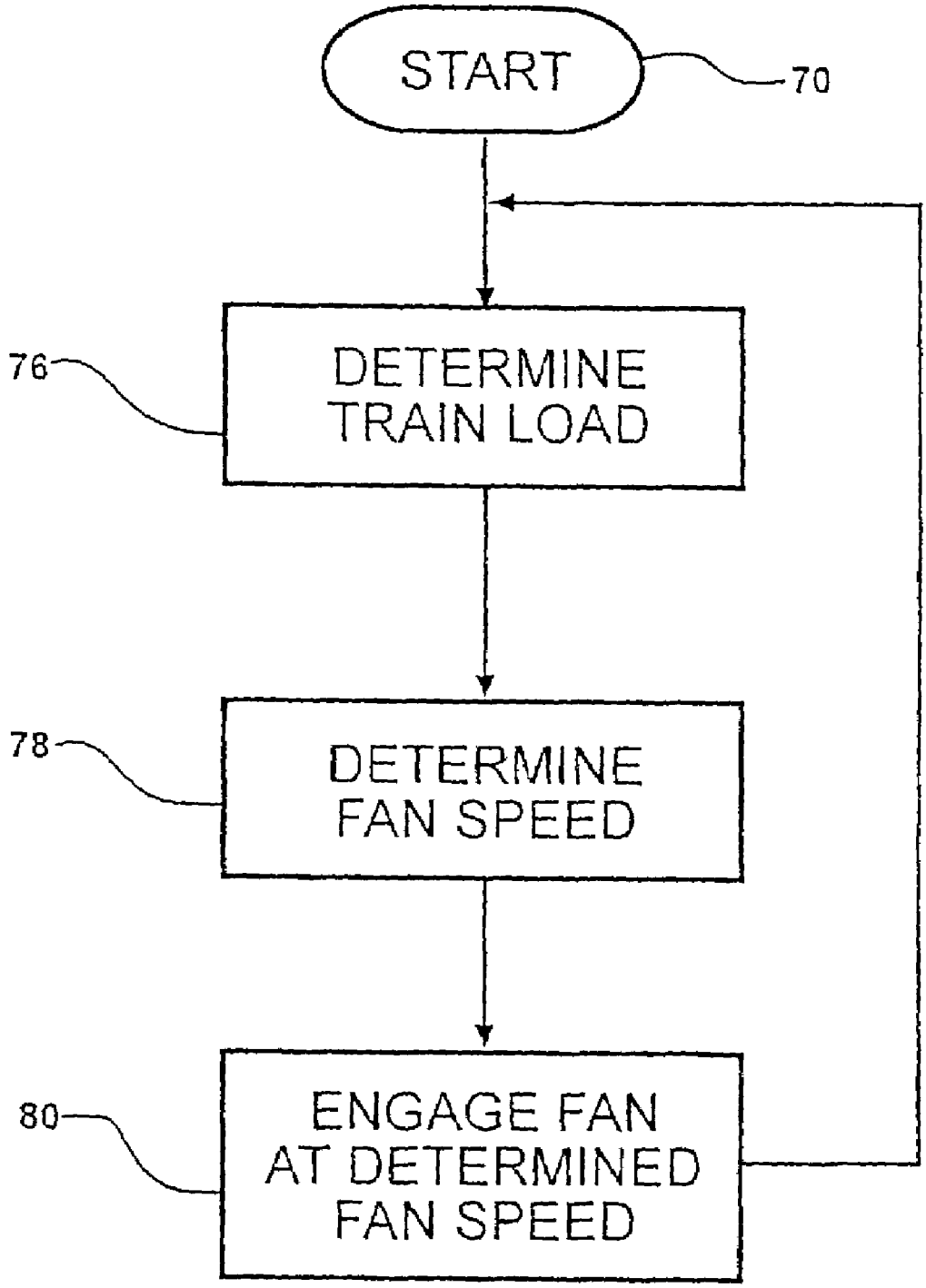
FIG. 6 is a flow diagram illustrating the steps performed by the smoke generating device according to an embodiment of the present invention.

Referring now to FIG. 6, the method for generating smoke begins at step 70. At 76, the loading on the train is determined. The controller 46 can receive input from the communication line corresponding to the loading on the engine model train. The loading on the model train can correspond to a voltage across an engine of the model train or a speed at which the model train is moving. As seen in FIG. 4, The controller 46 can communicate with a sensor 47 engaged with a wheel 49 of the model train 22. The sensor 47 can sense the angular velocity of the wheel 49 and communicate the speed of the wheel 49 to the controller 46.

Figure 7:
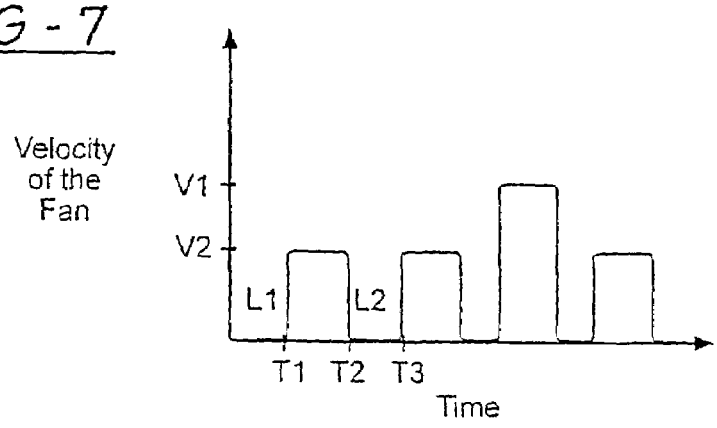
FIG. 7 is a graph illustrating an example of the relationship between the velocity of the fan and time.

Referring to FIG. 6, At 78, the appropriate angular velocity of the fan is determined by the controller in accordance with a control program stored in memory. In FIG. 7, an illustrative graph is provided to show movement of the fan over time to produce a puffing pattern of smoke. A puff of smoke is emitted from an aperture of the model train. The time period lasting from T1 to T2 is the duration of a puff of smoke. The time period lasting from T2 to T3 is the interval between puffs of smoke. Preferably, the fan can be engaged at velocity V1 in as short a period of time as possible, represented by a substantially vertical line L1 on the graph.

Also, the fan 32 can preferably be disengaged from velocity V1 to zero velocity in as short a period of time as possible, represented by a substantially vertical line L2 on the graph. More specifically the smoke unit stops the fan by temporarily reversing the current to motor. By temporarily reversing the current the fan stops abruptly thereby enhancing the puffing action of the smoke unit. As the time periods required to engage the fan up to velocity V1 and disengage the fan 32 down from velocity V1 decrease, a relatively more well defined puff of smoke will be emitted from the aperture of the train.

Figure 8:
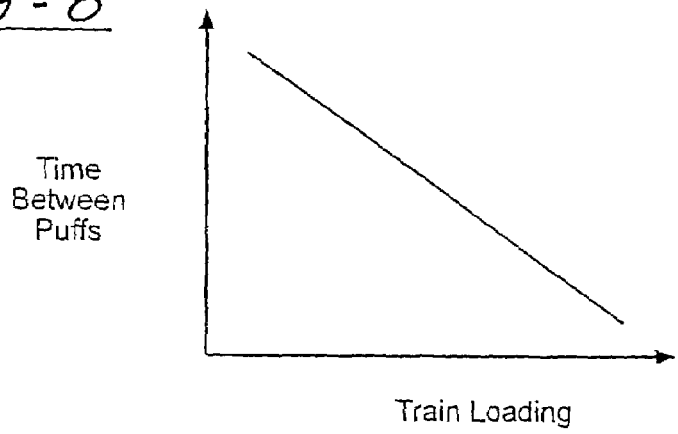
FIG. 8 is a graph illustrating the relationship between the time interval between puffs of smoke and the loading on the engine.
Figure 9:
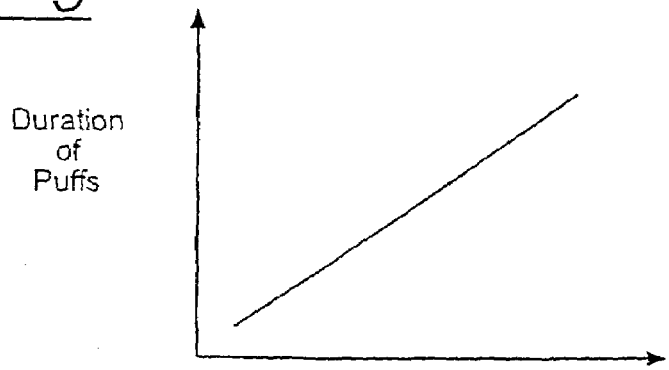
FIG. 9 is a graph illustrating the relationship between the duration of puffs of smoke and the loading on the engine.

As the loading on the train increases, the controller can move the fan at a greater angular velocity, or increase the duration of puffs of smoke, or shorten the duration between puffs of smoke. For example, for a train modeled after a steam locomotive that puffs smoke, the puffs of smoke can be generated at increasing intervals as train speed increases and can be generated at decreasing intervals as the train speed decreases. Alternatively, the puffs of smoke can be generated at increasing intervals as engine load increases and can be generated at decreasing intervals as the engine load decreases. For a train modeled after a diesel engine that does not emit smoke in a puffing pattern, more smoke can be generated as the train speed increases and less smoke can be generated as the train speed decreases. Alternatively, more smoke can be generated as engine load increases and less smoke can be generated as engine load decreases. Referring now to FIGS. 8 and 9, graphs are provide to show that the time between puffs decreases as loading on the train increases. Also, the duration of individual puffs of smoke increases as loading on the engine increases.

Referring now to FIG. 6, at step 80 the controller engages the motor to rotate the fan at the desired angular velocity. After the fan has been engaged at the desired velocity, the process returns to step 76 to determine loading on the engine. The controller can continuously monitor the loading on the engine or can monitor the loading on the engine at predetermined intervals. For example, the controller can be operable to monitor the loading on the train every five seconds, every ten seconds or any time period desired.

Referring now to FIG. 10, the present invention provides an apparatus 112 for forming smoke to be emitted by an amusement device, the apparatus comprising a support member 114 and a smoke generating element 116 having a length and an outer surface 118, the support member 114 in contact with the smoke generating element 116 along at least part of the length and in contact with less than the entire outer surface for the at least part of the length.

In FIG. 10, the entire length of the smoke generating element 116 contacts the support member 114 at a portion 120 of the outer surface 118 of the smoke generating element 116. However, the invention is not so limited. In particular, the smoke generating element 116 can be formed to extend beyond an end 124 of the support member 114. In such an embodiment of the invention, the support member 114 would be in contact with the smoke generating element 116 less than the entire length of the smoke generating element 116.

To the extent that the support member 114 contacts the smoke generating element 116, the contact occurs at portion 120 of the outer surface. As shown in FIG. 11, the portion 120 is less than the entire outer surface 118. The smoke generating element 116 is shown having a generally circular cross-section (shown elliptical in FIG. 11 due to the choice of cross-sectional plane). Portion 120 is shown as a point. However, the smoke generating element 116 can have a non-circular cross-section including a portion 120 having a predetermined width.

As shown in FIG. 10, a smoke generating element 116 extends along a generally helical path around a support member 114. Support member 114 is shown having a rectangular cross-section, so the smoke generating element 116 is not a true helix. However, in an embodiment where support member 114 is cylindrical, the smoke generating element 116 can be formed in the shape of a true helix.

Apparatus 112 includes a support member 114 for supporting the smoke generating element 116. It is believed that the position of the support member 114 relative to the smoke generating element 116 enhances and prolongs the operating life of the smoke generating element 116.

The support member 114 has a predetermined length and can have a rectangular cross-section. Alternatively, as shown in FIG. 12, the support member 114*a* can have a circular cross-section including an aperture 126 extending the length of the support member 114*a*. The aperture 126 can be formed to extend a predetermined distance through the support member 114*a*, a distance less than the length of the support member 114*a*, or can be formed to extend the length of the support member 114*a*. The support member 114 can be formed having any cross-section, including an irregular geometric cross-section. The support member 114 can be formed to have different or inconsistent cross-sections, such as partially cylindrical and partially rectangular with blending portions. In FIG. 10, the support member 114 is shown having a consistent, rectangular cross-section along the entire length of the support member 114. Furthermore, the cross-section of the support member 114 can be constant along the length of the support member 114 or can be variable, such as two differently-sized rectangular cross sections. In FIG. 10, the support member 114 is shown having a constant, rectangular cross-section along the entire length of the support member 114.

The length and cross-section of the support member 114 can be varied to enhance the resistive properties of the apparatus 112. For example, a relatively longer support member 114 can support a relatively longer smoke generating element 116 having a greater resistance than a relatively shorter smoke generating element 116. A relatively thicker support member 114 can support a relatively longer smoke generating element 116 having a greater resistance than a relatively shorter smoke generating element 116. Preferably, the electrical resistance across the apparatus is 6.3 ohms, plus or minus five percent, at twenty-five (25) degrees Celsius.

The support member 114 can be fabricated from a non-conductive material capable of maintaining a rigid or semi-rigid form up to a temperature of 530° Celsius. Preferably, the support member 114 is fabricated from braided fiberglass. Preferably, in a rectangular embodiment of the support member 114, the support member is 3.2 millimeters wide and 0.25 millimeters thick. Preferably, in a tube-shaped support member 114*a*, as shown in FIG. 12, the inside diameter of the support member 114*a* is 3.2 millimeters and the wall thickness is 0.25 millimeters.

The smoke generating element 116 is supported by the support member 114 along at least part of the length of the smoke generating element 116. The smoke generating element 116 can be a nickel chromium wire. Preferably, the smoke generating element 116 is fabricated from an alloy of 61% nickel, 15% chromium and 24% iron. Preferably, the wire is 0.25 millimeters in diameter. The smoke generating element 116 is in electrical communication with an electrical power source (not shown) to heat the smoke generating element 116 and burn oil or smoke fluid to form smoke.

The smoke generating element 116 can extends along a generally helical path around the support member 114. The lead of the helix and the development of the helix can be varied as desired to modify the resistance across the apparatus 112. In particular, the number of turns the smoke generating element 116 completes around the support member 114 over a length of the support member 114 and the distance between adjacent turns 128 and 130 can be increased or decreased to change the resistance across the smoke generating element 112.

The distance between turns 128 and 130 can be constant along the length of the support member 114 are be varied. For example, as shown in FIG. 13, the apparatus 112 can be positioned in a sub-housing 216. The sub-housing 216 can be positioned in a model train 222. A model train 222 includes an aperture 224 adjacent the apparatus 112 in the sub-housing 216, the aperture for dispensing smoke fluid or oil in the sub-housing 216. The turns of the smoke generating element 116 around the support member 114 can be relatively closer at a position adjacent the aperture 224 to enhance the likelihood that smoke fluid contacts the smoke generating element 116. The turns can be spaced further apart at other positions along the length of the support member 114 where smoke fluid is unlikely to contact.

The apparatus 112 can also include at least one terminal 132 to immovably associate the support member 114 with respect to the amusement device, such as a model train 222. Preferably, the apparatus includes two terminals 132 and 134 disposed at opposite ends of the support member 114. The terminals 132 and 134 can be fabricated from brass and can include apertures 136 and 138, respectively, for receiving additional mounting means such as a screw, bolt, or pin 120 as shown in FIG. 13.

The terminals 132 and 134 can be permanently connected to the support member 114 or releasibly associated. The terminals 132 and 134 shown in FIG. 10 include projections 140 and 142. The projections 140 and 142 are disposed about the support member 114. The projections 140 and 142 can be bent or crimped around the support member 114.

The smoke generating element 116 can be disposed between the support member 114 and either terminal 132 or 134. In addition, the smoke generating element 116 can be disposed between the support member 114 and the individual terminal at both ends of the support member 114. Preferably, the terminals 132 and 134 are sufficiently wide to engage at least two turns of the smoke generating element 116 about the support member 114 as shown in FIG. 10. Electric communication between the terminals 132 and 134 and the smoke generating element 116 is enhanced when at least two turns of the smoke generating element 116 are in disposed between the support member 114 and the terminals 132 and 134. Furthermore, the stability of the smoke generating element 116 with respect to the support member 114 is enhanced when two turns of the smoke generating element 116 are positioned between the support element 114 and the terminals 132 or 134.

Referring now to FIG. 13, the first sub-housing 216 can include a lamina 226. Lamina 226 is a thin plate, scale or layer made of fibrous material to absorb the oil directed into the first sub-housing 216 through the aperture 224. Lamina 226 can absorb and retain oil to be heated by the apparatus 112. Lamina 226 is operable to withstand the maximum thermal energy generated by the apparatus 112.

A second sub-housing 218 is mounted to an interior surface 220 of model train 222 and houses a fan 232 of a blower 214 for directing an air stream through the sub-housing 216. In a preferred embodiment of the invention, the fan 232 is a squirrel cage fan. However, the fan 232 can also be any type of fan including, but not limited to, an axial fan, a radial flow fan, a mixed flow fan or a cross-flow fan. Fan 232 is positioned internally with respect to the second sub-housing 218. A motor 234 for rotating the fan 232 is positioned externally with respect to the second sub-housing 218. However, the invention can be practiced with the fan 232 and the motor 234 positioned internally with respect to the second sub-housing 218. Rotation of fan 232 draws the air stream through an aperture 236 of model train 222. While the aperture 236 is shown positioned adjacent the second sub-housing 218, the invention can be practiced with aperture 236 positioned spaced apart from the second sub-housing 218. A conduit can be positioned between the aperture 236 and the second sub-housing 218, placing the aperture 236 and the second sub-housing 218 in fluid communication with respect to each other. The air stream is directed through openings 230 and 228 into sub-housing 216.

A controller 246 is a micro-controller operable to receive input signals and emit output signals and can be an PIC12C508 chip. The controller 246 is in communication with the engine 248 of the train. The voltage across the engine of the train is communicated to the controller 246 and, based on a program stored in memory, the controller 246 can control the operation of the motor 234 to control an airstream generated by the fan 232. The controller 246 can control a rate of the airstream. The direction of the motor 234 can be controlled by alternating the voltage across the motor 234. The velocity of the motor 234 can be changed by changing the level of voltage across the motor 234 with the controller 246.

The controller 246 can receive input corresponding to the loading on the engine model train. The loading on the model train can correspond to a voltage across an engine of the model train or a speed at which the model train is moving. The controller 246 can communicate with a sensor 247 engaged with a wheel 249 of the model train 222. The sensor 247 can sense the angular velocity of the wheel 249 and communicate the speed of the wheel 249 to the controller 246. The controller 246 can then control the speed of the fan 232 in response to the angular velocity of the wheel 249 detected by the sensor 247.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An apparatus for producing puffs of smoke to be emitted by a toy train, the apparatus comprising:

a smoke generating element;

a fan that directs an airstream toward the smoke generating element;

a motor operatively coupled to the fan to the turn the fan to generate the airstream; and a controller operatively coupled to the motor to control an angular velocity of the fan, the controller being configured to:

provide a current to the motor to control durations of the puffs of smoke; and reverse the current to the motor to abruptly stop the fan and thereby produce well-defined intervals between the puffs of smoke;

wherein the airstream directed toward the smoke generating element is adjusted in response to at least one of train load and train speed, thereby enhancing puffing action of the train.

2. The apparatus of claim 1, wherein the durations of the puffs of smoke are increased as load on the train increases.

3. The apparatus of claim 1, wherein the intervals between the puffs of smoke are decreased as load on the train increases.

4. The apparatus of claim 1, wherein the angular velocity is increased as load on the train increases.

5. The apparatus of claim 1, wherein the durations of the puffs of smoke are increased as train speed increases.

6. The apparatus of claim 1, wherein the intervals between the puffs of smoke are decreased as train speed increases.

7. The apparatus of claim 1, wherein the angular velocity is increased as train speed increases.

8. The apparatus of claim 1, further comprising a memory with a control program, wherein the control program determines the durations of the puffs of smoke in response to the at least one of the train load and the train speed.

9. The apparatus of claim 1, further comprising a memory with a control program, wherein the control program determines the intervals between the puffs of smoke in response to the at least one of the train load and the train speed.

10. The apparatus of claim 1, wherein the smoke generating element comprises a length and an outer surface.

11. The apparatus of claim 10, further comprising a support member in contact with the smoke generating element along at least a part of the length and in contact with less than the entire outer surface for the at least part of the length.

12. The apparatus of claim 11, wherein the support member comprises braided fiberglass.

13. The apparatus of claim 1, wherein the smoke generating element further comprises a nickel chromium wire.

14. The apparatus of claim 1, wherein the smoke generating element forms a plurality of turns around the support member.

15. A method for producing puffs of smoke to be emitted by a toy train that includes a smoke generating element, a fan for directing an airstream toward the smoke generating element, and a motor operatively coupled to the fan to the turn the fan to generate the airstream, the method comprising:

providing a current to the motor to control durations of the puffs of smoke; and reversing the current to the motor to abruptly stop the fan and thereby produce well-defined intervals between the puffs of smoke; and adjusting the airstream directed toward the smoke generating element in response to at least one of train load and train speed, and thereby enhance puffing action of the train.

16. The method of claim 15, wherein adjusting the airstream toward the smoke generating element comprises increasing the duration of the puffs of smoke in response to increased load on the train.

17. The method of claim 15, wherein adjusting the airstream toward the smoke generating element comprises decreasing the intervals between the puffs of smoke in response to increased load on the train.

18. The method of claim 15, wherein adjusting the airstream toward the smoke generating element comprises increasing an angular velocity of the fan in response to increased load on the train.

19. The method of claim 15, wherein adjusting the airstream toward the smoke generating element comprises increasing the duration of the puffs of smoke in response to increased speed of train.

20. The method of claim 15, wherein adjusting the airstream toward the smoke generating element comprises decreasing the intervals between the puffs of smoke in response to increased speed of train.

21. The method of claim 15, wherein adjusting the airstream toward the smoke generating element comprises increasing an angular velocity of the fan in response to increased speed of train.

* * * * *